US010044128B1

(12) United States Patent
Shultz et al.

(10) Patent No.: US 10,044,128 B1
(45) Date of Patent: Aug. 7, 2018

(54) MODULAR, REPAIRABLE, AIRCRAFT GROUND POWER RECEPTACLE, METHOD OF REPAIR AND REPAIR KIT

(71) Applicant: Innovative Electrical Design, Inc., Plattsburgh, NY (US)

(72) Inventors: Preston D. Shultz, Woodstock, CT (US); Kevin Crowl, Jay, NY (US)

(73) Assignee: Innovative Electrical Design, Inc., Plattsburgh, NY (US)

( * ) Notice: Subject to any disclaimer, the term of this patent is extended or adjusted under 35 U.S.C. 154(b) by 0 days.

(21) Appl. No.: 15/666,385

(22) Filed: Aug. 1, 2017

(51) Int. Cl.
*H01R 13/04* (2006.01)
*H01R 13/42* (2006.01)

(52) U.S. Cl.
CPC ..... *H01R 13/42* (2013.01)

(58) Field of Classification Search
CPC H01R 13/42; H01R 13/5213; H01R 13/6275; H01R 13/631
USPC ..... 439/697
See application file for complete search history.

(56) References Cited

U.S. PATENT DOCUMENTS

| | | | | |
|---|---|---|---|---|
| 4,857,011 | A | 8/1989 | Shultz et al. | |
| 5,437,558 | A * | 8/1995 | Sakuraoka | H01R 13/631 439/140 |
| 7,371,102 | B2 * | 5/2008 | Sakamoto | H01R 13/6275 439/352 |
| 7,686,630 | B2 * | 3/2010 | Takehara | H01R 13/5213 439/140 |
| 7,955,128 | B2 | 6/2011 | Shultz et al. | |
| 2013/0095700 | A1 | 4/2013 | Shultz et al. | |

* cited by examiner

*Primary Examiner* — Jean F Duverne
(74) *Attorney, Agent, or Firm* — Downs Rachlin Martin PLLC

(57) ABSTRACT

A modular, repairable aircraft ground power receptacle includes a base containing pin bases with outwardly opening sockets. Removable pins are secured in the sockets and a pin cover plate is placed there over with prong ends of pins extending through the pin cover plate for connection with a ground power plug. Damage pins may be removed and replaced without disconnecting aircraft power cables from the receptacle. Repair kits may include replacement pins and, optionally, replacement cover plates and related fasteners and tooling.

20 Claims, 3 Drawing Sheets

MODULAR, REPAIRABLE, AIRCRAFT GROUND POWER RECEPTACLE, METHOD OF REPAIR AND REPAIR KIT

FIELD OF THE INVENTION

The present invention generally relates to the field of aircraft ground power devices. In particular, the present invention is directed to a modular, repairable aircraft ground power receptacle, method of repair and repair kit.

BACKGROUND

Commercial aircraft, in general, while on the ground, are powered by ground power units that connect to the aircraft through a flexible rubber plug that is either molded to the power cable or manually attached to the same cable. The rubber plug is then attached to a ground power receptacle located in an accessible location on the aircraft fuselage. In the standard connection type, the receptacle has protruding pins that are received in sockets on the plug. The receptacle is also mounted through the fuselage of the aircraft in a manner that maintains the pressure seal for the aircraft. Repair or replacement of a conventional receptacle thus typically requires breaking and then resealing the pressure seal around the receptacle.

SUMMARY OF THE DISCLOSURE

Embodiments disclosed herein include a modular, repairable, aircraft ground power receptacle, which comprises receptacle base member, plural pin bases, plural connection pins and a pin cover plate. The receptacle base member has an inner side and an outer side. The plural pin bases extend at least in part through the receptacle base member, each with an electrical connector extending from the inner side and a socket opening extending to the outer side. The plural connection pins are each associated with a pin base, and the connection pins have an attachment end configured and dimensioned to be received in and mate with the socket of its associated pin base to form an electrical connection there between. The connection pins also have prong ends configured and dimensioned to mate with a ground power plug. The connection pins are removable from the pin bases without disconnecting internal aircraft power cables attached to the electrical connectors of the pin bases and without breaking the pressure seal between the receptacle and surrounding fuselage. The pin cover plate defines plural pin openings, with each opening corresponding in size and position to one of the connection pins. The pin cover plate is attachable to the base member outer side with the connection pins extending there through.

In another embodiment, a method of repairing an aircraft ground power receptacle with said receptacle mounted to an aircraft, includes removing a pin cover plate from an outer side of the receptacle, removing at least one connection pin from an associated socket of a pin base mounted in the receptacle, inserting a new connection pin into the associated socket in place of the removed connection pin, and replacing the pin retaining plate on the outer side of the receptacle and over the new connection pin. With such a method, the pin bases, which are connected to aircraft power cables within the aircraft, need not be disconnected to accomplish the removing and inserting of the connection pins.

Other disclosed embodiments include a repair kit for an aircraft ground power receptacle, in which the repair kit contains at least one replacement pin having a pin prong end configured and dimensioned to be received through an opening in a pin cover plate of the receptacle and to mate with an aircraft ground power plug. The replacement pin also has a pin attachment end configured and dimensioned to be received in, mate with and form an electrical connection with a socket of a pin base mounted in the receptacle.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DETAILED DESCRIPTION

Embodiments described herein relate to receptacles mounted on aircraft to receive ground power from a ground power unit via a standard ground power cable and plug. Dimensions and connection force for aircraft ground power connectors have been standardized under various specifications depending on aircraft type and power requirements. Examples of such specifications include Military Specification MS25486H for "Connector, Plug, Attachable, External Electric Power, Aircraft, 115/200 Volt, 400 Hertz" and SAE Aerospace Standard AS21378 for "Plugs and Cable Assemblies, External Power, Aircraft, 230-400 Volt, 400 Hertz," each of which is incorporated by reference herein.

Depending on the type of plug used with the ground power unit, it can be heavy and somewhat unwieldy when attached to the fairly large and stiff power cable. Some plugs may weigh in the range of 15 pounds and be over a foot long. Further, a relatively high force can be required to properly seat the plug in the receptacle. These factors can lead to damage of both the ground power cable/plug and/or receptacles. If a cable or plug is damaged, it can be readily swapped out for a new cable/plug without significant delay. The damaged cable or plug can later be repaired or replaced without immediate effect on ground operations of the aircraft. However, if the receptacle is damaged, because it is generally integrated into both the aircraft fuselage, forming part of the pressure seal of the aircraft, and the aircraft power system, replacement or repair can require significant time because the receptacle typically must be removed, including work in the avionics bay disconnecting aircraft power cables from the receptacle and breaking the pressure seal, and then reattaching the cables and plugs and reconfirming the pressure seal, all of which must be done in careful, quality controlled manner. Such a process can significantly impact ground operations. Embodiments described herein provide a receptacle that can be easily repaired with minimum of tools and without requiring disconnection from internal aircraft power cables or removal of the receptacle from the aircraft.

Figure 1:
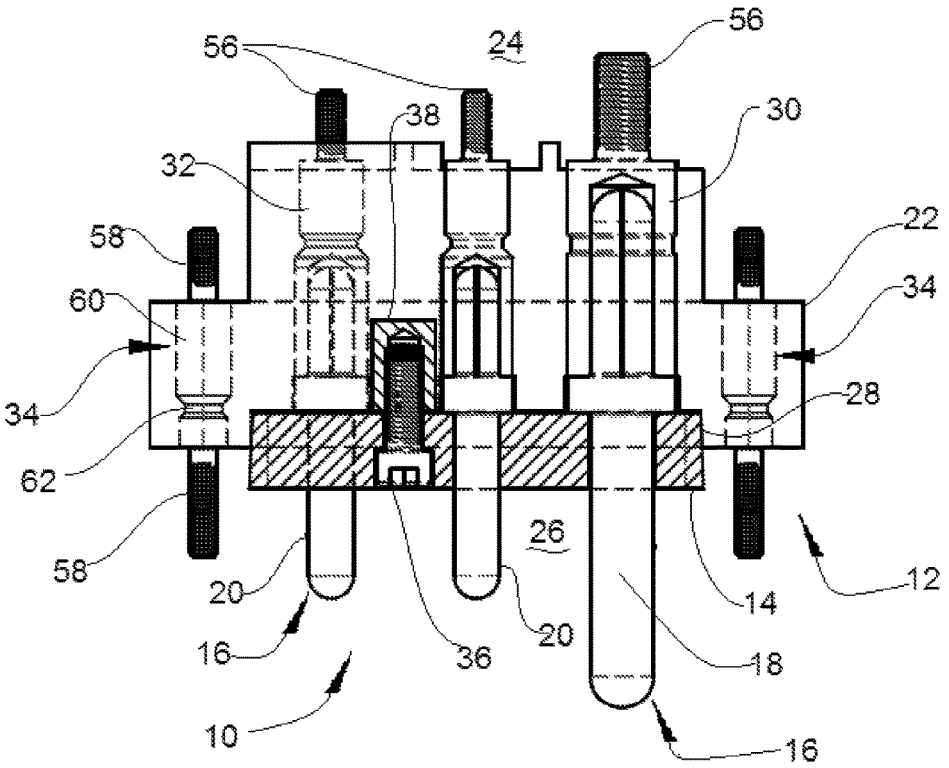
FIG. 1 is a cross section (as viewed through line A-A of FIG. 2) of an embodiment of a modular, repairable aircraft ground power receptacle disclosed herein.
Figure 2:
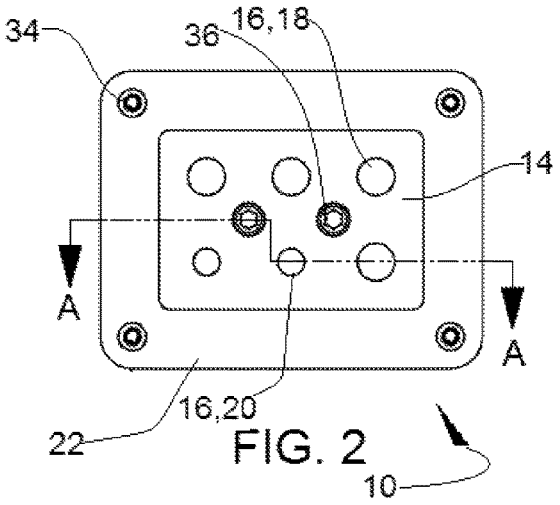
FIG. 2 is a front view of an embodiment as shown in FIG. 1.
Figure 3:
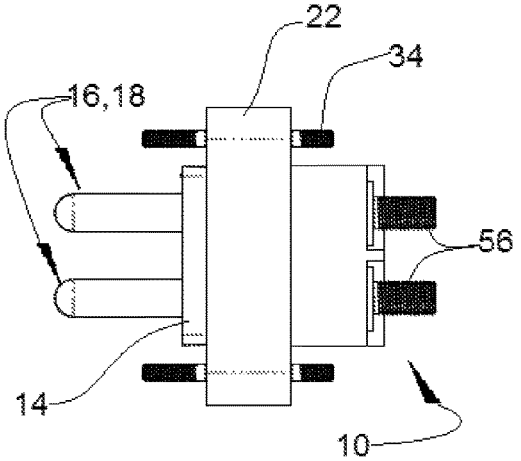
FIG. 3 is a side view of an embodiment as shown in FIGS. 1 and 2.

Referring to FIG. 1, one example of an embodiment of a modular, repairable ground power receptacle 10 is shown. In this embodiment, receptacle 10 includes base assembly 12, which receives pin cover plate 14 to retain pin assemblies 16 therein. In this embodiment, also with reference to FIGS. 2 and 3, there are shown four power pins 18 and two relay pins. Base assembly 12 may include base 22, which, with reference to its installation orientation on an aircraft, has an inner side 24 and outer side 26. Pin assemblies 16 are captured in base 22 and the base defines a recess 28 into which pin retainer plat 14 is received. More specifically, power pin base 30 and relay pin base 32 are contained within base 22. In addition, captive base fasteners 34 may be captured within base 22 for attachment of the receptacle to the aircraft on the inner side and attachment of a cover and/or guard on the outer side. Fasteners 36 are used to secure the pin cover plate 14 as described further below.

Base 22 may be formed of a hard molded, non-conductive rubber or plastic with suitable insulating properties. In one alternative, pin bases 30, 32 and captive base fasteners 34 may be properly positioned in a mold and then the mold filed with the material for base 22. In this manner, the components are securely captured in the insulating material of the base. If desired, captive nuts 38 also may be molded into base 22 to provide threads to receive fasteners 36. While molding in this manner provides a convenient and efficient way to produce base 22 with captured components as described, embodiments described herein may be produced by other means and the description is not limited to a particular method of manufacture.

Figure 4A:
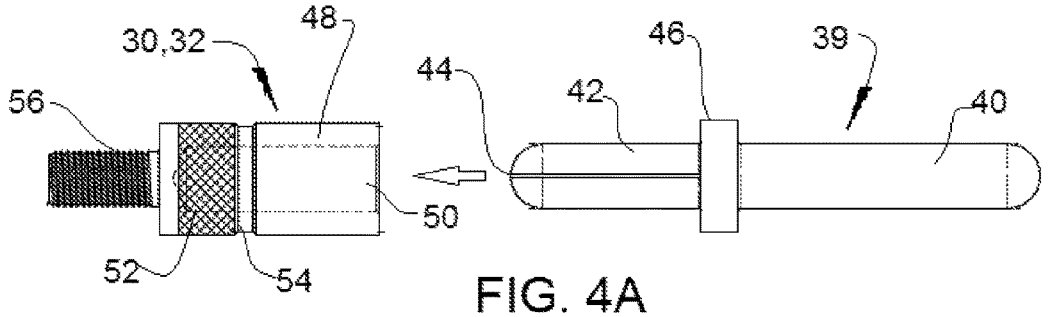
FIG. 4A is an exploded view.
Figure 4B:
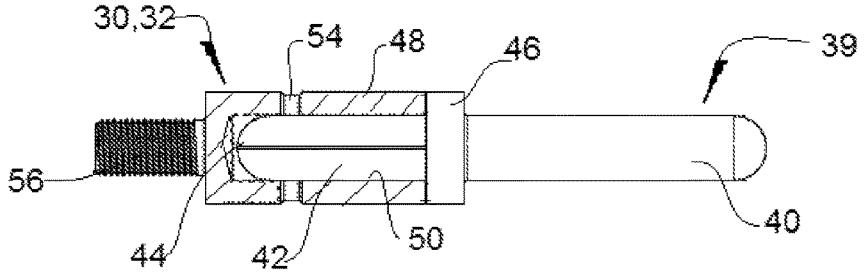
FIG. 4B is a partial cross-sectional view, of a pin assembly according to embodiments disclosed herein.

In some embodiments, the pin assembly for power pins and relay pins may have substantially the same configuration with the primary difference being only relative size. One example of such a configuration is shown in FIGS. 4A and 4B. In this example, pin assemblies 16 generally include pin bases 30, 32 as previously mentioned and pin 39 with a prong end 40 and attachment end 42. Attachment end 42 may be provided with one or more central slits to increase the resilience for holding and connecting purposes as described below. Enlarged pin collar 46 is disposed between prong end 40 and attachment end 42. Pin cover plate 14 is provided with openings 47 sized to closely receive prong ends 40 when placed there over. Enlarged collar 46 prevents pins 39 from moving out through openings 47 and pin cover plate 14 thus captures and retains the pins in their respective pin bases.

Pin bases 30, 32 may include socket body 48, which defines socket 50. The outer surface of socket body 48 may be formed with a roughened surface 52 (such as a knurled surface) and necked portion 54, features which may help to secure the pin bases in the molded base 22. For example, the roughened surface may help resist rotational forces and the necked portion may help to resist longitudinally applied forces such as when pins are pushed in or pulled out. Extending from socket body 48, opposite socket 50, connector 56 is configured to extend out of the inner side of base 22 and provide for connection to aircraft internal electrical cables. In the illustrated example, connector 56 is shown with threads to receive a threaded clamp type connector element. Other suitable electrical connection types also may be employed as connector 56. Captive base fasteners 34 also may be provided with features to help secure them in a molded base 22, including, for example, body 60 with a knurled surface (for example like knurled surface 52) and necked portion 62. Threaded ends 58 are positioned to extend out of base 22 on the inner and outer sides.

Figure 5:
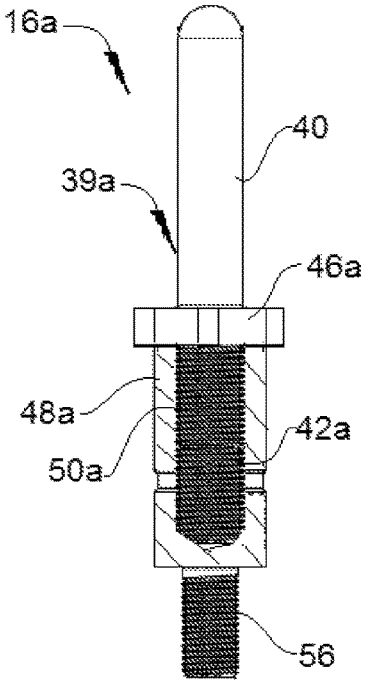
FIG. 5 is a side view of an alternative pin assembly embodiment.
Figure 6:
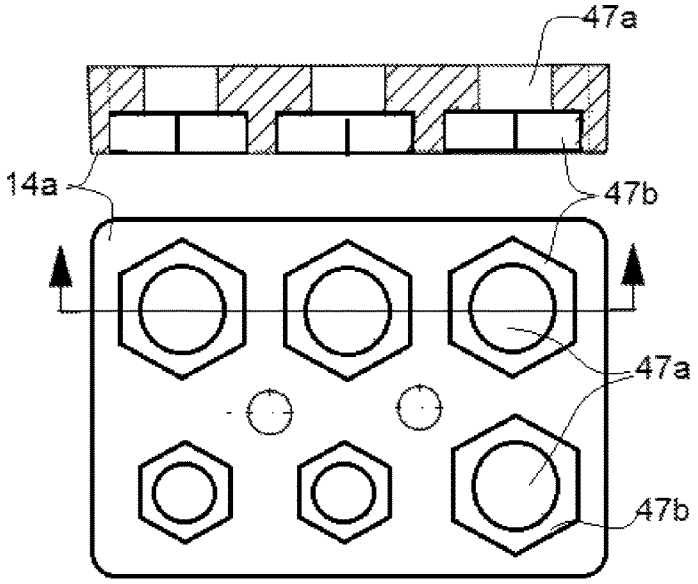
FIG. 6 is combined inside plan view and cross section of an alternative pin cover plate embodiment for use with the pin assembly of FIG. 5.

An alternative pin assembly 16*a* is illustrated in FIG. 5. In this alternative embodiment, pin 39*a* has a threaded attachment end 42*a* that mates with internal threads in socket 50*a* of socket body 48*a*. Collar 46*a* is shaped to permit a tool to engage pin 39*a* to screw it into socket 50*a*. A hex shape is illustrated for collar 46*a*, suitable to engage a standard socket, but other shapes may be employed for this purpose. Along with alternative pin assembly 16*a*, an alternative pin cover plate 14*a* is employed as shown in FIG. 6. Cover plate 14*a* has openings 47*a* to receive prong ends 40 as previously described, but also has hex-shaped recesses 47*b* around each opening to receive and mate with hex-shaped collars 46*a*. Other features of pin assembly 16*a* and pin cover plate 14*a* not mentioned in this paragraph are as previously described.

Figure 7:
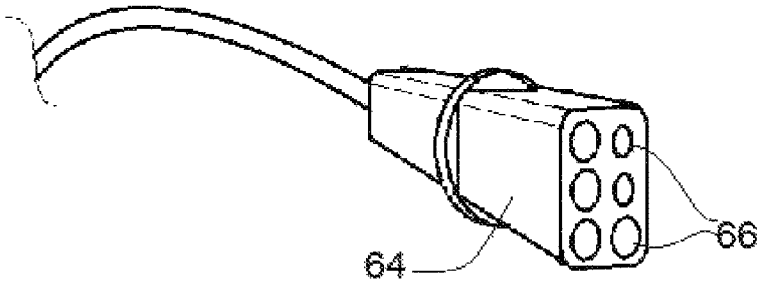
FIG. 7 illustrates an example of a 115-400 v, 400 hz, six pin, ground power plug as may be used with the receptacles described herein
Figure 8:
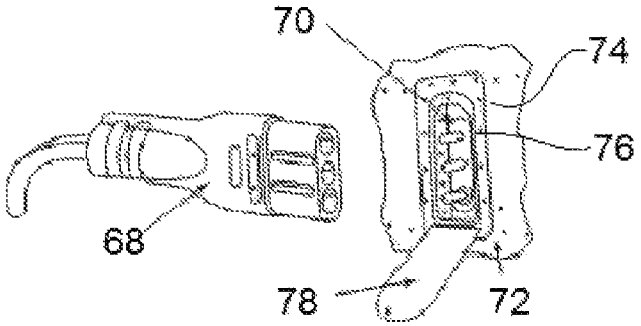
FIG. 8 illustrates a alternative, 28 volt DC, 3 pin, ground power plug and alternative receptacle embodiment mounted in an aircraft fuselage opening.

FIG. 7 illustrates an example of a 400 hz, six pin, ground power plug 64 as may be used with the receptacles described herein. Sockets 66 are sized to mate with prong ends 40 with an appropriate interference according to applicable specifications. Modular, repairable ground power receptacles as described herein are not limited specifically to six pin embodiments. In another example, shown in FIG. 8, three pin receptacle 70 is configured to mate with a 28 volt DC, 3 pin, ground power plug 68. FIG. 8 also illustrates one embodiment of an installation in an aircraft, in which receptacle 70 is mounted in a recess 74 in aircraft fuselage 72 using a mounting member/seal 76, which may be closed by access door 78. Mounting frame/seal 76 is typically configured to form a pressure seal around the opening in the aircraft fuselage and then also receive the receptacle base and form a pressure seal therewith. Different arrangements of mounting frames and seals may be devised to mate with the receptacle embodiments as described herein by persons of ordinary skill in the art. Such an installation arrangement may be used with receptacles as described herein having any number of pins or electrical capacities.

When receptacles are damaged in service, the most common component damaged are the extending prongs of the pins that are received in the plug sockets. Referring again to FIGS. 1, 4A and 4B, replacement of pins 39 in embodiments described herein is explained. When a pin 39 is damaged and must be replaced, first, fasteners 36, which secure pin cover plate 14, are removed with an appropriate tool. Such a tool may be, for example a hex head driver. Cover plate 14 is then removed, which allows pins 39 to be pulled out of sockets 50 of pin bases 30, 32. Only pins that are damaged may need to be replaced, or alternatively all pins may be replaced at the same time. Attachment end 42 of pins 39 is configured with an interference fit with the walls of socket 50. Slit 44 may be provided in attachment end 42 to create additional resilience in the attachment end to facilitate placement and removal of the pin without compromising the contact between the attachment end and the socket wall, which is also an electrical connection interface. After replacing pins as needed, pin cover plate 14 is replaced and secured to base 22 by fasteners 36.

As indicated above, one advantage of embodiments disclosed herein is the ability to repair or replace pins of the receptacle without disturbing the pressure seal of the aircraft. Ordinarily with a typical, conventional receptacle, maintenance people would have to go inside the avionics bay of the aircraft, disconnect the cable between the aircraft bus and the receptacle, and then break the pressure seal and remove and replace the conventional receptacle. In contrast, receptacle embodiments described herein can be serviced entirely from outside the aircraft and do not require entrance into the avionics bay to effect repair or replacement of pins as described above.

As will be appreciated, the replacement procedure is modified appropriately to accommodate screw threaded attachment ends 42*a* when alternative pin assembly 16*a* is used with alternative pin cover plate 14*a* as shown in FIGS. 5 and 6. In particular, rather than pushing the attachment end into the socket to overcome the interference fit, pin 39*a* is screwed into threaded socket 50*a* using an appropriate tool engaging shaped collar 46*a*. Care should be taken to ensure that the shape of collars 46*a* are properly oriented so as to receive the correspondingly shaped recesses 47*b* on cover plate 14*a*.

For aircraft utilizing modular, repairable ground power receptacles as described herein, receptacle repair kits may be provided. Such a receptacle repair kit may include, at a minimum, replacement pins 39, but also may include replacement pin cover plates 14, cover plate fasteners 36 and, optionally, an appropriate tool for driving fasteners 36. When alternative pin assembly 16*a* is used with alternative cover plate 14*a*, an additional tool configured to engage collar 46*a* also may be included in the kit.

The foregoing has been a detailed description of illustrative embodiments of the invention. It is noted that in the present specification and claims appended hereto, conjunctive language such as is used in the phrases "at least one of X, Y and Z" and "one or more of X, Y, and Z," unless specifically stated or indicated otherwise, shall be taken to mean that each item in the conjunctive list can be present in any number exclusive of every other item in the list or in any number in combination with any or all other item(s) in the conjunctive list, each of which may also be present in any number. Applying this general rule, the conjunctive phrases in the foregoing examples in which the conjunctive list consists of X, Y, and Z shall each encompass: one or more of X; one or more of Y; one or more of Z; one or more of X and one or more of Y; one or more of Y and one or more of Z; one or more of X and one or more of Z; and one or more of X, one or more of Y and one or more of Z.

Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present invention. Additionally, although particular methods herein may be illustrated and/or described as being performed in a specific order, the ordering is highly variable within ordinary skill to achieve aspects of the present disclosure. Accordingly, this description is meant to be taken only by way of example, and not to otherwise limit the scope of this invention.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A modular, repairable, aircraft ground power receptacle, comprising:

a receptacle base member with an inner side and an outer side;

plural pin bases extending at least in part through the receptacle base member, each with an electrical connector extending from said inner side and a socket opening to said outer side of the base member;

plural connection pins, one each associated with a pin base, said connection pins having an attachment end configured and dimensioned to be received in and mate with the socket of the associated pin base to form an electrical connection there between, and a prong end configured and dimensioned to mate with a ground power plug, said connection pins being removable from the pin bases without breaking aircraft pressure seal or disconnecting aircraft power cables attached to the electrical connectors of the pin bases; and a pin cover plate defining plural pin openings, each opening corresponding in size and position to one said connection pin, the pin cover plate being attachable to the base member outer side with said connection pins extending there through.

2. The modular, repairable, aircraft ground power receptacle as in claim 1, wherein each said connection pin has a pin collar disposed between the attachment end and prong end, said pin collar having an outer dimension greater in breadth than the pin opening through which the connection pin extends.

3. The modular, repairable, aircraft ground power receptacle as in claim 2, wherein said socket opening and pin attachment end are sized to provide an interference fit of the attachment end in the socket opening and said pin collar is further sized with respect the pin cover plate openings to prevent the pin from moving out of the socket opening through the pin cover plate with the cover plate secured to the base member.

4. The modular, repairable, aircraft ground power receptacle as in claim 3, wherein the pin attachment end has at least one slit to increase resiliency.

5. The modular, repairable, aircraft ground power receptacle as in claim 1, wherein:

said socket opening has an internal thread and the pin attachment end has a mating external thread to create a threaded connection there between; and each said connection pin has a tool engagement section disposed at an outer end of the threaded attachment end to permit engagement of a tool for rotation of the pin in and out of the threaded socket opening.

6. The modular, repairable, aircraft ground power receptacle as in claim 5, wherein:

said tool engagement section comprises an enlarged collar around the pin between the prong end and attachment end; and the pin cover plate has recesses around the pin openings shaped to receive said enlarged collars.

7. The modular, repairable, aircraft ground power receptacle as in claim 1, wherein the pin cover plate is secured to the outer side of the base member by at least one fastener.

8. The modular, repairable, aircraft ground power receptacle as in claim 1, wherein the base member is formed in a mold of an insulating material with the pin bases integrally molded therein.

9. The modular, repairable, aircraft ground power receptacle as in claim 8, wherein the pin bases have a roughed surface to engage the material of the base member to resist rotation.

10. The modular, repairable aircraft ground power receptacle as in claim 8, wherein the pin bases have a necked portion to engage the material of the base member to resist longitudinal forces applied thereto.

11. The modular, repairable aircraft ground power receptacle as in claim 1, further comprising base fasteners extending from inner and outer sides of the base member.

12. The modular, repairable aircraft ground power receptacle as in claim 11, wherein the base member is formed in a mold with said base fasteners integrally molded therein, the base fasteners including at least one of roughened surfaces or a necked portion within the molded base member.

13. A method of repairing an aircraft ground power receptacle with said receptacle mounted to an aircraft, comprising:

removing a pin cover plate from an outer side of the receptacle;

removing at least one connection pin from an associated socket of a pin base mounted in the receptacle;

inserting a new connection pin into the associated socket in place of the removed connection pin; and replacing the pin retaining plate on the outer side of the receptacle and over the new connection pin.

14. The method of repairing an aircraft ground power receptacle as in claim 13, further comprising opening an access panel on the aircraft to obtain access to the receptacle.

15. The method of repairing an aircraft ground power receptacle as in claim 13, wherein:

said removing at least one connection pin comprises pulling the connection pin from the socket of the pin base by applying a force sufficient to overcome an interference fit between the pin and socket;

said inserting a new connection pin comprises pushing the connection pin into the socket of the pin base by applying a force sufficient to overcome the interference fit between the pin and socket; and retaining the new connection pin in the receptacle by fastening the pin cover plate over the connection pins with a pin collar around each pin engaging an inner side of the pin cover plate.

16. The method of repairing an aircraft ground power receptacle as in claim 13, wherein:

said removing at least one connection pin comprises unscrewing the connection pin from a threaded socket of the pin base;

said inserting a new connection pin comprises screwing the new connection pin into the threaded socket of the pin base.

17. The method of repairing an aircraft ground power receptacle as in claim 13, wherein:

said receptacle is mounted in the aircraft to form a pressure seal with the aircraft structure between the inner side and outer side of the receptacle with said pin bases connected to aircraft power cables on the inner side;

and said removing and inserting are done without breaking the pressure seal and without disconnecting the aircraft power cables from the pin bases of the receptacle.

18. A repair kit for an aircraft ground power receptacle, comprising at least one replacement pin having a pin prong end configured and dimensioned to be received through an opening in a pin cover plate of the receptacle and to mate with an aircraft ground power plug, and a pin attachment end configured and dimensioned to be received in, mate with and form an electrical connection with a socket of a pin base mounted in the receptacle.

19. The repair kit for an aircraft ground power receptacle as in claim 18, further comprising:

at least one replacement pin corresponding to each pin in the ground power receptacle; and a replacement pin cover plate defining a pin receiving opening for each pin of the ground power receptacle.

20. The repair kit for an aircraft ground power receptacle as in claim 19, further comprising at least one fastener to secure the replacement pin cover plate to the receptacle and a tool for driving the fastener.

* * * * *